US008523320B2

(12) United States Patent
Nagoshi et al.

(10) Patent No.: US 8,523,320 B2
(45) Date of Patent: Sep. 3, 2013

(54) INKJET RECORDING APPARATUS AND INKJET RECORDING METHOD

(75) Inventors: Shigeyasu Nagoshi, Yokohama (JP); Satoshi Azuma, Kawasaki (JP); Yoshiaki Murayama, Tokyo (JP); Minoru Teshigawara, Saitama (JP); Susumu Hirosawa, Tokyo (JP); Yutaka Kano, Yokohama (JP); Takeshi Murase, Yokohama (JP); Kentarou Muro, Tokyo (JP); Masao Kato, Kawasaki (JP); Minako Kato, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 136 days.

(21) Appl. No.: 12/960,429

(22) Filed: Dec. 3, 2010

(65) Prior Publication Data

US 2011/0310178 A1 Dec. 22, 2011

(30) Foreign Application Priority Data

Jun. 18, 2010 (JP) ..... 2010-139954

(51) Int. Cl.
*B41J 2/21* (2006.01)

(52) U.S. Cl.
USPC ..... 347/43; 347/40; 347/42

(58) Field of Classification Search
USPC ..... 347/20, 40–43, 49, 85–86, 100
See application file for complete search history.

(56) References Cited

U.S. PATENT DOCUMENTS

| | | | | |
|---|---|---|---|---|
| 5,376,958 | A * | 12/1994 | Richtsmeier et al. | 347/104 |
| 6,299,287 | B1 * | 10/2001 | Williams et al. | 347/43 |
| 6,808,249 | B1 | 10/2004 | Kneezel et al. | |
| 7,380,896 | B2 | 6/2008 | Wada | |
| 2006/0214957 | A1 | 9/2006 | Wada | |

FOREIGN PATENT DOCUMENTS

| | | | |
|---|---|---|---|
| JP | 2005-178378 | A | 7/2005 |
| JP | 2006-264152 | A | 10/2006 |
| JP | 2009-160876 | A | 7/2009 |

* cited by examiner

*Primary Examiner* — Thinh Nguyen
(74) *Attorney, Agent, or Firm* — Canon USA Inc. IP Division

(57) ABSTRACT

The present invention provides a recording apparatus including recording heads each including a plurality of nozzle arrays that are arranged so as to overlap, wherein overlapping portions of the recording heads for two different colors are separated from each other with a distance therebetween in an array direction of nozzles.

13 Claims, 13 Drawing Sheets

INKJET RECORDING APPARATUS AND INKJET RECORDING METHOD

BACKGROUND OF THE INVENTION

1. Field of the Invention

The present invention relates to an inkjet recording apparatus and an inkjet recording method for recording an image on a recording medium by using an inkjet recording head.

2. Description of the Related Art

Japanese Patent Laid-Open No. 2005-178378 describes a full-line inkjet recording apparatus that includes a recording head and a conveying mechanism for conveying a recording medium. In the recording head, nozzle arrays (chips), each having a plurality of nozzles, are arranged in a staggered manner. The full-line inkjet recording apparatus performs recording over the entire width of a recording medium.

In general, overlapping portions exist in a full-line recording apparatus, because a plurality of chips are arranged in a staggered manner. The overlapping portions perform recording using two chips. Therefore, if the density balance between the two chips is not correct, the density of an image formed by these chips may become non-uniform, which reduces the quality of the image. Such a non-uniform density may be inconspicuous for a monochrome image. However, if the overlapping portions are disposed at the same position for different colors, an imbalance in the density is exaggerated and easily recognized as a non-uniform density.

In contrast, in the recording apparatus describe in Japanese Patent Laid-Open No. 2005-178378, the overlapping portions for different colors are displaced from each other in the nozzle array direction, so that the effect of a non-uniform density described above is reduced.

However, when a recording medium is obliquely conveyed, regions recorded by the overlapping portions for different colors overlap, and the density of a recorded image may become non-uniform.

SUMMARY OF THE INVENTION

According to an aspect of the present invention, an inkjet recording apparatus includes a recording unit configured to perform recording by moving recording heads each corresponding to one of a plurality of colors relative to a recording medium and by ejecting inks having the plurality of colors from the recording heads, the plurality of colors including a first color and a second color, the recording heads each including a plurality of nozzle arrays that are arranged so as to be displaced from each other in an array direction of nozzles so that the nozzle arrays have an overlapping portion in an intersecting direction that intersects the array direction, wherein the overlapping portion of the recording head for the first color and the overlapping portion of the recording head for the second color are adjacent to each other in the array direction, and wherein the overlapping portion of the recording head for the first color and the overlapping portion of the recording head for the second color are separated from each other in the array direction.

According to another aspect of the present invention, inkjet recording method includes performing recording by moving recording heads each corresponding to one of a plurality of colors relative to a recording medium and by ejecting inks having the plurality of colors from the recording heads, the plurality of colors including a first color and a second color, the recording heads each including a plurality of nozzle arrays that are arranged so as to be displaced from each other in an array direction of nozzles so that the nozzle arrays have an overlapping portion in an intersecting direction that intersects the array direction, wherein the overlapping portion of the recording head for the first color and the overlapping portion of the recording head for the second color are adjacent to each other in the array direction, and wherein the overlapping portion of the recording head for the first color and the overlapping portion of the recording head for the second color are separated from each other in the array direction.

The present invention provides a recording apparatus that uses recording heads each including a plurality of chips (nozzle arrays) that are disposed so as to overlap each other, overlapping of regions on which recording is performed using overlapping portions for different colors is suppressed, whereby occurrence of non-uniform density is reduced.

Further features of the present invention will become apparent from the following description of exemplary embodiments with reference to the attached drawings.

DESCRIPTION OF THE EMBODIMENTS

First Embodiment

Figure 1:
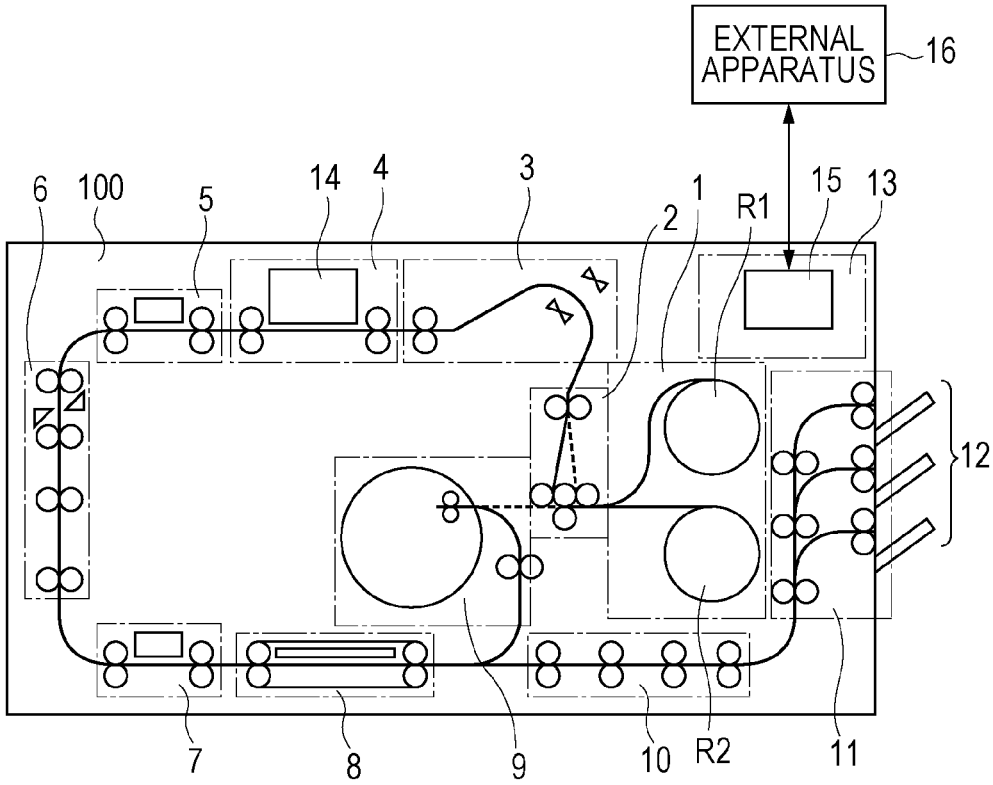
FIG. 1 is a schematic view of an inkjet recording apparatus to which the present invention is applicable.

The present invention is broadly applicable to an inkjet recording apparatus that performs recoding by moving a recording head, which ejects ink, relative to a recording medium. Hereinafter, the structure of a printer will be described in detail. FIG. 1 is a schematic view of an inkjet recording apparatus 100 (hereinafter, simply referred to as a recording apparatus or a printer 100) to which the present invention is applicable. The printer 100 includes a sheet feeding unit 1, a decurling unit 2, an oblique sheet correction unit 3, a printing unit 4, an inspection unit 5, a cutter unit 6, an information recording unit 7, a dryer unit 8, a sheet winding unit 9, an output/conveyance unit 10, a sorter unit 11, an output tray 12, and a control unit 13. A recording medium (sheet) is conveyed along a sheet conveying path by a conveying mechanism illustrated with a solid line in FIG. 1, and the above units perform various processing on the sheet.

The sheet feeding unit 1 contains and feeds a rolled continuous sheet. The sheet feeding unit 1 contains two rolls R1 and R2, and feeds a sheet from one of the rolls R1 and R2 that is selected. Alternatively, the sheet feeding unit 1 may contain only one roll or more than two rolls. The decurling unit 2 reduces curling (warping) of a sheet that has been fed from the sheet feeding unit 1. The decurling unit 2 includes two pinch rollers and one driving roller. The decurling unit 2 warps the sheet in a direction opposite to curling of the sheet and pinches the sheet between the rollers so as to reduce the curling. The oblique sheet correction unit 3 corrects oblique conveyance (inclination with respect to the proper conveyance direction) of the sheet that has passed through the decurling unit 2. In the oblique sheet correction unit 3, an edge of the sheet to be aligned is pressed against a guiding member, so that the oblique conveyance of the sheet is corrected.

The printing unit 4 forms an image on the sheet using a recording head 14 while the sheet is being conveyed. The printing unit 4 includes a plurality of conveying rollers that convey the sheet. The recording head 14 is a full-line recording head, in which nozzles are formed so as to extend over the entire width of the sheet. A plurality of recording heads are arranged in the conveying direction. In the present embodiment, recording heads for seven colors, including black (Bk), light cyan (Lc), light magenta (Lm), gray (Gy), yellow (Y), magenta (M), and cyan (C), are arranged. Ink may be ejected from the nozzles by using exothermic elements, piezoelectric elements, electrostatic element, or MEMS elements. Color inks are respectively supplied from ink tanks to the recording heads through ink tubes.

The inspection unit 5 optically reads a test pattern or an image printed on the sheet by the printing unit 4, and thereby inspects the state of nozzles in the recording head, the state of sheet conveyance, and the position of the image. The cutter unit 6 includes a mechanical cutter that cuts the sheet, which has being printed, into cut sheets having a predetermined length. The cutter unit 6 includes a plurality of conveying rollers for feeding the sheet to the next step. The information recording unit 7 records print-related information, such as a serial number of printing or the date of printing, on the back side of the sheet that has been cut. The dryer unit 8 dries the ink in a short time by heating the sheet that has been printed by the printing unit 4. The dryer unit 8 includes a conveying belt and a conveying roller for feeding the sheet to the next step.

The sheet winding unit 9 temporarily winds a continuous sheet, whose front side has been printed, when duplex printing is performed. The sheet winding unit 9 includes a winding drum for winding the sheet. When the front side has been printed, the continuous sheet is temporarily wound around the winding drum before being cut. After the sheet has been wound, the winding drum rotates in a reverse direction, and the sheet is fed to the decurling unit 2 and to the printing unit 4. Because the sheet has been reversed, the printing unit 4 can print the back side of the sheet. The duplex printing operation will be described in detail below.

The output/conveyance unit 10 conveys the sheet, which has been cut by the cutter unit 6 and dried by the dryer unit 8, to the sorter unit 11. When necessary, the sorter unit 11 sorts the printed sheets into groups and outputs the groups of sheets to different trays of the output tray 12. The control unit 13 performs the overall control of the printer.

Figure 2:
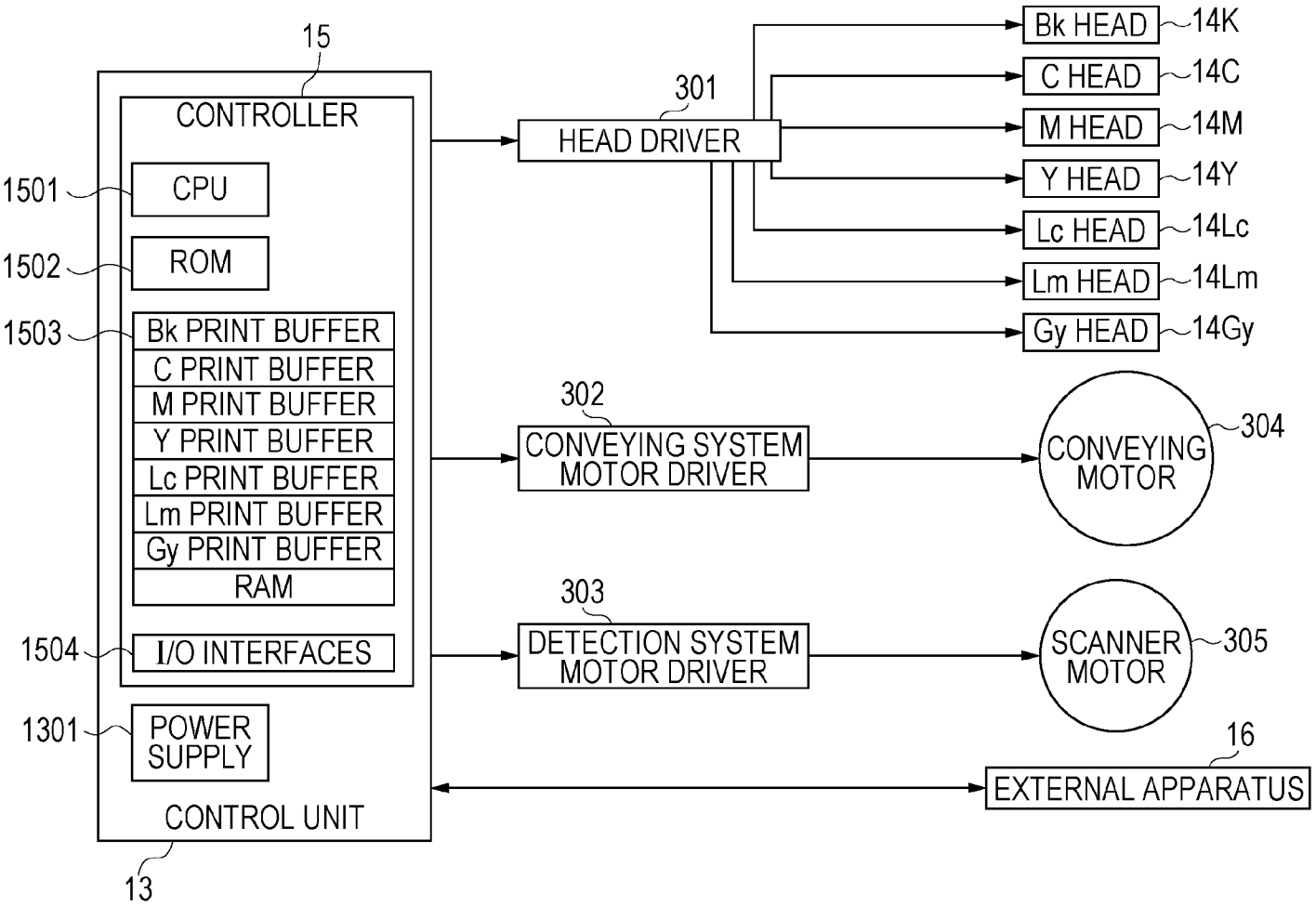
FIG. 2 is a schematic block diagram of a control unit of the inkjet recording apparatus of FIG. 1.

FIG. 2 is a control block diagram of the printer. The control unit 13 includes a controller 15 and a power supply 1301. The controller 15 includes a CPU 1501, a ROM 1502, a RAM 1503, and I/O interfaces 1504. An operation of the printer is controlled on the basis of a command that is sent from the controller 15 or an external apparatus 16, which is connected to the controller 15 through the I/O interfaces 1504, such as a host computer.

When the controller 15 receives a signal from the external apparatus 16, the controller 15 generates recording data to be recorded on the sheet S using the recording head. The recording data is stored in the RAM 1503 as a print buffer. Moreover, the controller 15 transfers the data in the print buffer to a head driver 301. The head driver 301 converts the data into data for ejecting ink droplets using recording heads for different colors, and thereby performs a recording operation. The details of the image processing will be described below.

The controller 15 controls motor drivers, including a conveying system motor driver 302 and a detection system motor driver 303, so as to drive driving sources, such as a conveying motor 304 and a scanner motor 305, and thereby performs a sheet-conveying operation and a detection operation.

Figure 3A:
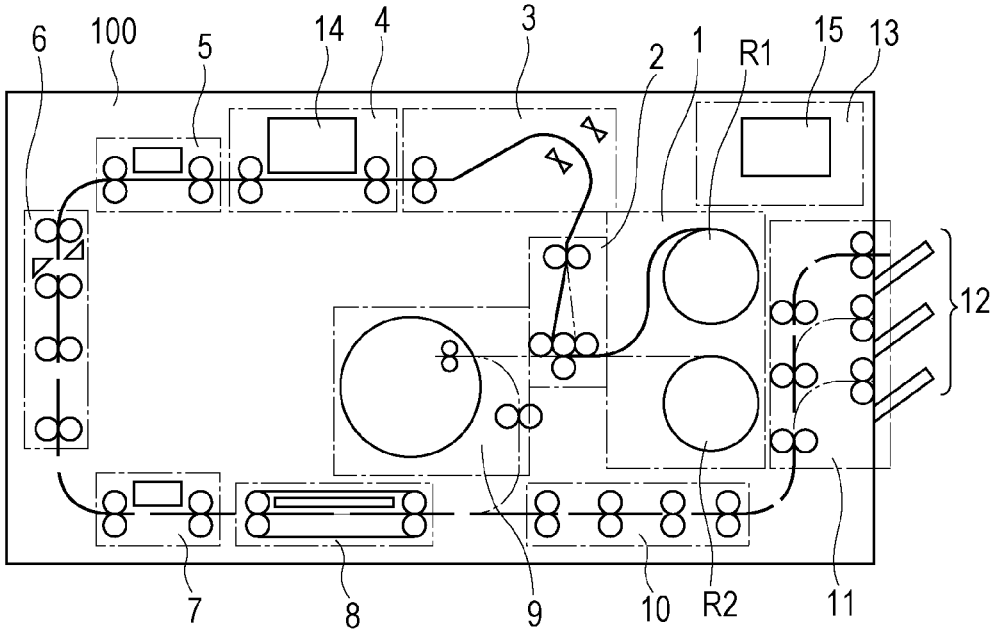
FIGS. 3A and 3B illustrate printing operations performed by the inkjet recording apparatus of FIG. 1.

Next, the basic operation of printing will be described. Both the simplex printing operation and the duplex printing operation will be described, because these are not the same. FIG. 3A illustrates the simplex printing operation. A thick line represents a conveying path along which a sheet is supplied from the sheet feeding unit 1, printed, and output to the output tray 12. The sheet is supplied from the sheet feeding unit 1, decurled by the decurling unit 2, and has the conveying direction corrected by the oblique sheet correction unit 3. Then, the printing unit 4 prints the first side of the sheet. The printed sheet passes through the inspection unit 5, and the cutter unit 6 cuts the sheet into cut sheets each having a predetermined length. When necessary, the information recording unit 7 records print-related information on a back side of the cut sheet. The cut sheets are individually conveyed to the dryer unit 8, which dries the cut sheets. Subsequently, the cut sheets pass through the output/conveyance unit 10 and are successively output to and stacked on the output tray 12 of the sorter unit 11.

Figure 3B:
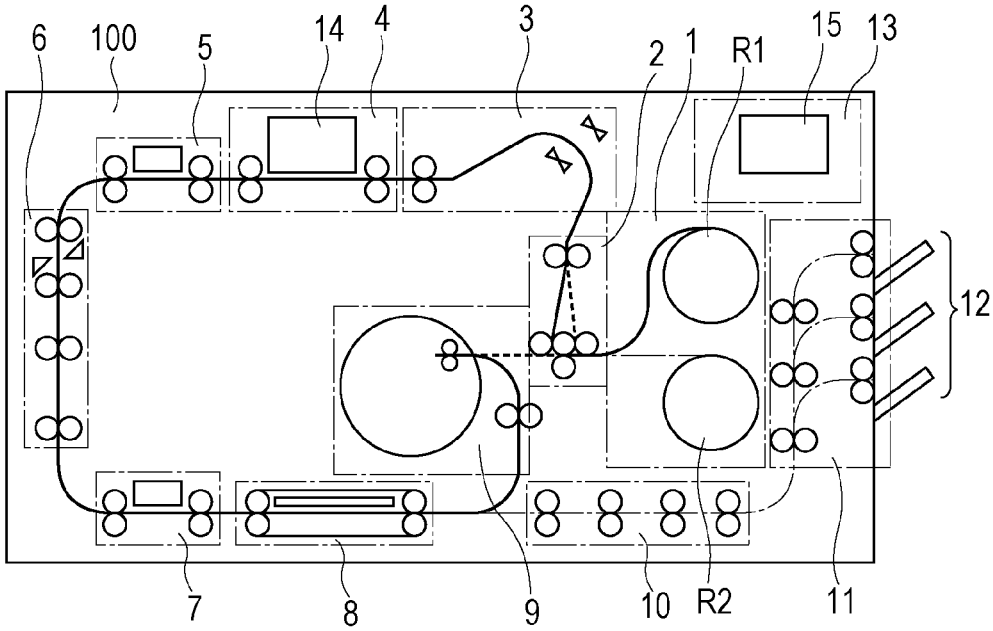

FIG. 3B illustrates the duplex printing operation. During the duplex printing operation, a front surface printing sequence and a back surface printing sequence are successively performed. In the front surface printing sequence, the units from the sheet feeding unit 1 to the inspection unit 5 perform operations the same as those for the simplex printing operation described above. The cutter unit 6 does not cut the continuous sheet, and the continuous sheet is conveyed the dryer unit 8. The dryer unit 8 dries ink on the front side of the sheet. Then, the sheet is conveyed to a path in the sheet winding unit 9 instead of a path in the output/conveyance unit 10. The sheet is wound around a winding drum of the sheet winding unit 9, which rotates in the normal direction (counterclockwise in the figures). When printing on the front side of the sheet is finished in the printing unit 4, the cutter unit 6 cuts the continuous sheet at a cut position, which is at the trailing end of the printed area. A part of the continuous sheet downstream of the cut position with respect to the conveying direction (a part including the printed area) passes through the dryer unit 8 and is wound by the sheet winding unit 9 until the trailing end of the sheet (the cut position) is wound. The remaining part of the continuous sheet upstream of the cut position with respect to the conveying direction is wound back by the sheet feeding unit 1 so that the leading end of the sheet (the cut position) does not remain in the decurling unit 2. Thus, the front surface printing sequence is finished.

When the front surface printing sequence is finished, the back surface printing sequence is started. In the back surface printing sequence, first, the winding drum of the sheet winding unit 9 rotates in a direction opposite to the winding direction (clockwise in the figures). The leading end of the sheet (i.e., the trailing end of the sheet when the sheet was wound) is fed into the decurling unit 2. The decurling unit 2 performs decurling in a direction opposite to that of the previous decurling operation. This is because the sheet has been wound around the winding drum of the sheet winding unit 9 in a reversed manner compared with the time when the sheet was wound around the sheet feeding unit 1, and the sheet is curled in the opposite direction. Then, the sheet passes through the oblique sheet correction unit 3, and the printing unit 4 prints the back side of the continuous sheet. The printed sheet passes through the inspection unit 5, and the cutter unit 6 cuts the continuous sheet into cut sheets each having a predetermined length. The information recording unit 7 does not record print information on the cut sheet because both sides of the cut sheet have been printed. The cut sheets are individually conveyed to the dryer unit 8, passes through the output/conveyance unit 10, and successively output to and stacked on the output tray 12 of the sorter unit 11. Thus, the back surface printing sequence is finished.

Figure 4A:
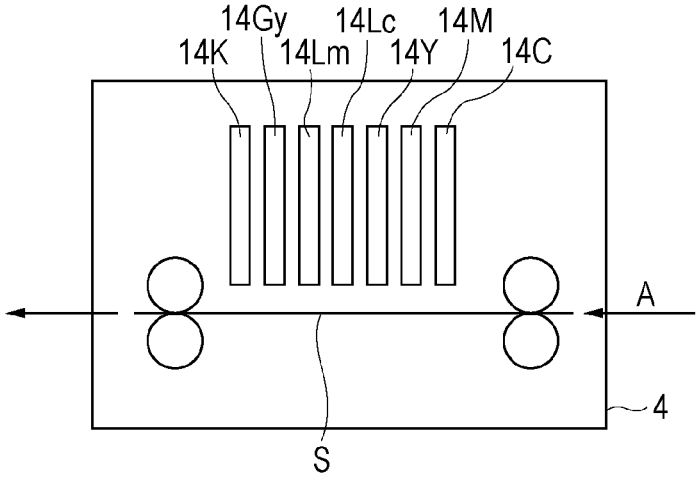
FIGS. 4A to 4E are schematic views of a printing unit of the inkjet recording apparatus of FIG. 1.

Next, the structure of the printing unit 4 of the present embodiment will be described. FIG. 4A is a schematic view of the printing unit 4 of the present embodiment. The printing unit 4 includes recording heads for seven colors: a recording head 14K, a recording head 14Lc, a recording head 14Lm, a recording head 14Gy, a recording head 14Y, a recording head 14M, and a recording head 14C. The recording head 14K ejects black ink, the recording head 14Lc ejects light cyan ink, and the recording head 14Lm ejects light magenta ink. The recording head 14Gy ejects gray ink, and the recording head 14Y ejects yellow ink. The recording head 14M ejects magenta ink, and the recording head 14C ejects cyan ink. A sheet S is conveyed in a conveying direction (direction of arrow A) that intersects (in the present embodiment, perpendicularly intersects) a direction in which nozzles are arranged (direction of arrow B). The recording head for seven colors successively perform recording on the sheet S.

Figure 4B:
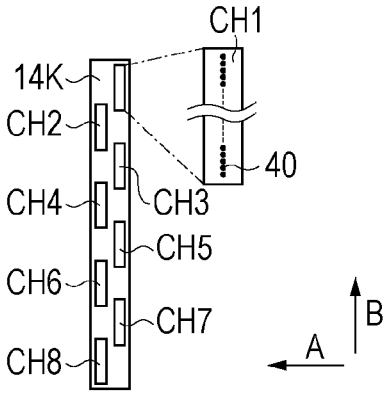

FIG. 4B illustrates the disposition of nozzles in the recording head 14K. The recording head 14K includes eight recording chips CH1 to CH8. Each chip includes a nozzle array having a plurality of nozzles 40 for ejecting ink. Each chip may include a plurality of nozzle arrays, and the plurality of nozzle arrays may be arranged so as to be displaced form each other with a distance smaller than the nozzle pitch. Dispositions of the nozzles in the recording heads for other colors are the same as that of the recording head 14K.

Figure 4C:
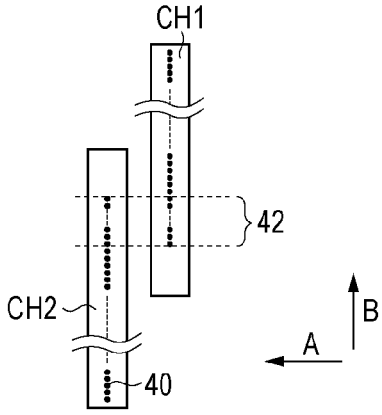
Figure 4D:
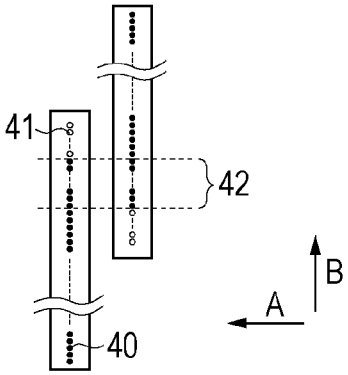
Figure 4E:
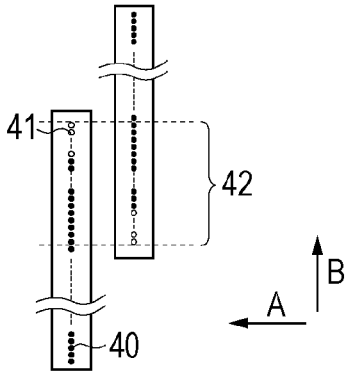

FIGS. 4C to 4E illustrate the overlapping portions of the chip CH1 and the chip CH2. The present invention is applicable to any of the structures of the recording heads illustrated in FIGS. 4C to 4E. In FIGS. 4C to 4E, the nozzles 40, which are represented by black circles, are nozzles used for recording. Nozzles 41, which are represented by white circles, are unused nozzles that are not used for recording. The unused nozzles 41 include two types of nozzles: nozzles that are capable of injecting ink and that are not used; and nozzles that are incapable of ejecting ink. The former type of nozzles are, for example, prepared for registration adjustment. The latter type of nozzles are, for example, disposed at an end of the nozzle array in order to prevent drying of nozzles.

FIG. 4C illustrates the case where the portion of the chips CH1 and CH2 that overlap in the conveying direction (direction of arrow A) is an overlapping portion 42, and all nozzles in the overlapping portion 42 are the used nozzles 40. FIG. 4D illustrates the case where a part of the portion of the chips CH1 and CH2 that overlap in the conveying direction (direction of arrow A) is the overlapping portion 42, and all nozzles in the overlapping portion 42 are the used nozzles 40. FIG. 4E illustrates the case where the portion of the chips CH1 and CH2 that overlap in the conveying direction (direction of arrow A) is the overlapping portion 42, and some of the nozzles, which are in end portions of the nozzle arrays, in the overlapping portion 42 are the unused nozzles 41 and the remaining nozzles in the overlapping portion 42 are the used nozzles 40. The present invention is applicable to any of the structures of the recording heads illustrated in FIGS. 4C to 4E. In the overlapping portions illustrated in FIGS. 4C to 4E, recording is performed by allocating recording data to two chips (nozzle arrays), so that a recording density in the overlapping portions becomes the same as that for nozzle areas other than the overlapping portions.

Figure 5:
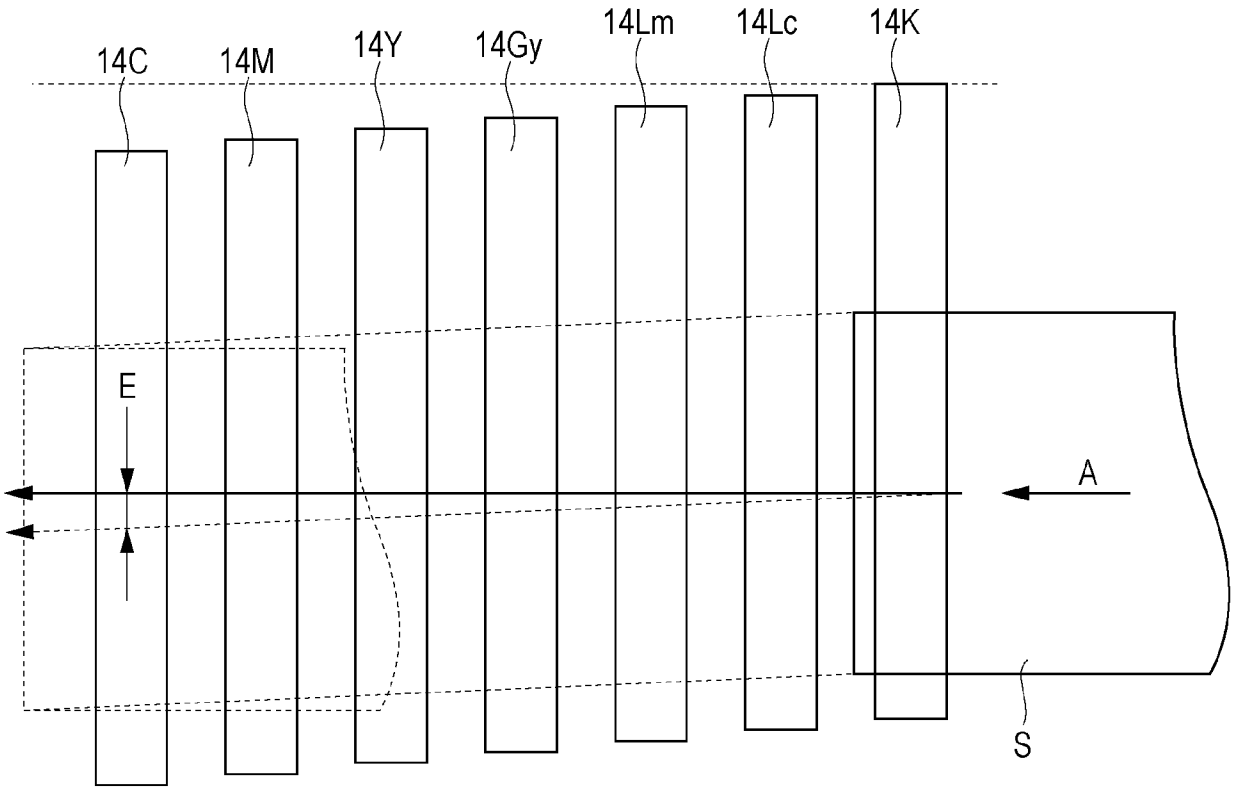
FIG. 5 illustrates deviation of a sheet S that is being conveyed.

FIG. 5 illustrates deviation of the sheet S that is being conveyed. The sheet S is obliquely conveyed if, for example, the diameter of the conveying roller varies in the nozzle array direction (direction of arrow B). FIG. 5 illustrates how the sheet S is obliquely conveyed. The sheet S is in the position illustrated with a solid line when the recording head 14K performs recording. However, when the sheet S is conveyed to the recording head 14C, the sheet S becomes deviated in the direction of arrow B to the position illustrated with a dotted line. Here, the sheet S deviates by a deviation E from the straight conveyance line. In particular, when the sheet S continuously deviates one-way in the nozzle array direction (downward in the case of FIG. 5) while being conveyed, the larger the distances between the recording heads, the larger the deviation of sheet S. If such a deviation in conveyance occurs with existing recording head structures, regions of the sheet on which recording is performed by the overlapping portions overlap, and non-uniform density may become conspicuous.

Characteristics of First Embodiment

Figure 6:
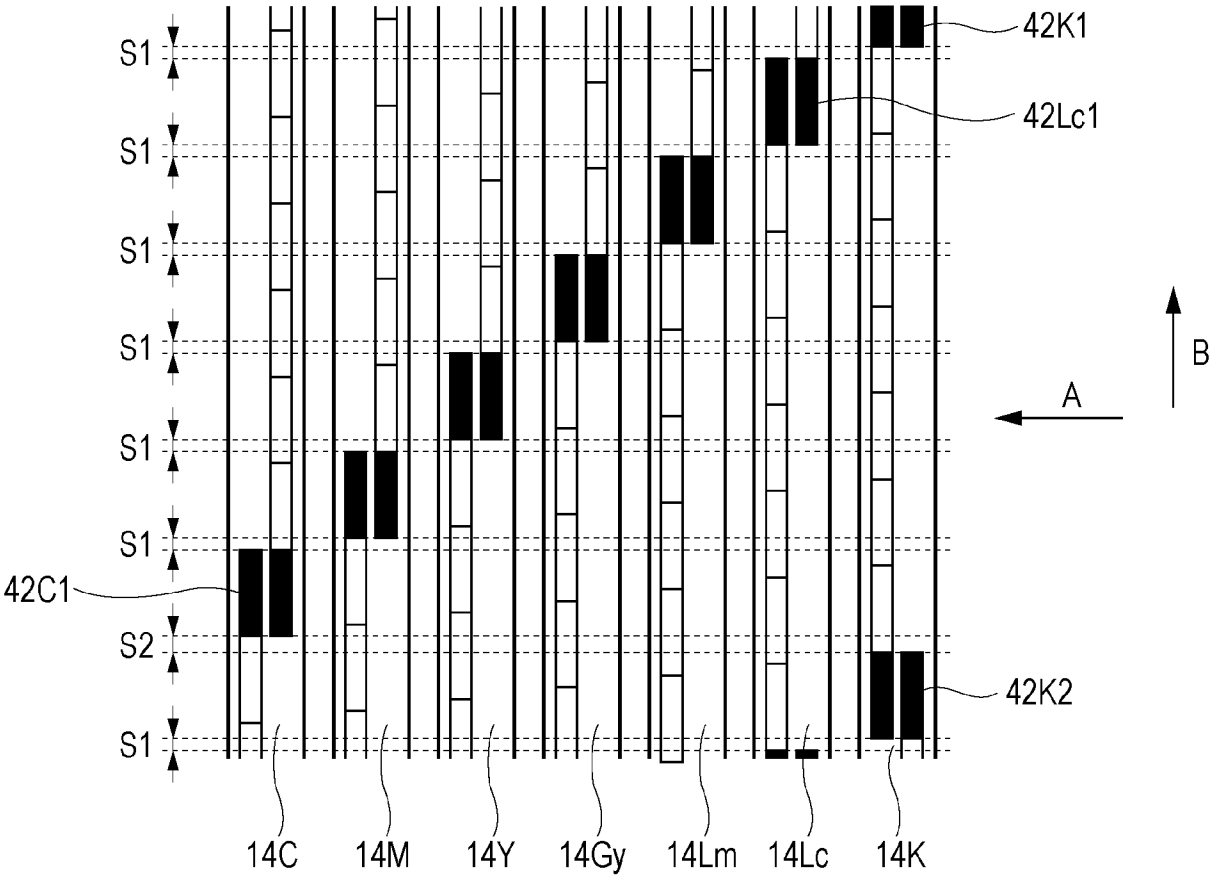
FIG. 6 illustrates the positional relationship between overlapping portions of recording heads according to a first embodiment.

FIG. 6 illustrates the positional relationship between overlapping portions for different colors in the printer according to the first embodiment. As illustrated in FIG. 6, in the present embodiment, recording heads 14K, 14Lc, 14Lm, 14Gy, 14Y, 14M, and 14C for seven colors are arranged in the conveying direction. Solid black portions in FIG. 6 are the overlapping portions of the recording heads. The recording head for each color includes eight chips. Therefore, each recording head has seven overlapping portions. However, in FIG. 6, only one or two overlapping portions are illustrated for each recording head.

As can be seen from FIG. 6, in the present embodiment, the overlapping portions of the recording heads that are adjacent to each other in the conveying direction are disposed with a distance therebetween in the nozzle array direction. Moreover, the overlapping portions of the recording heads that are the most separated from each other in the conveying direction are disposed with a distance therebetween in the nozzle array direction. That is, in the present embodiment, the overlapping portions that are adjacent to each other in the nozzle array direction are disposed with a distance therebetween in the nozzle array direction. Therefore, even when the sheet is obliquely conveyed, overlapping of regions of the sheet on which recording is performed by the overlapping portions of different colors is suppressed, so that occurrence of non-uniform density is reduced.

As described above, the printer according to the present embodiment is characterized in that, for all the recording heads of different colors, the overlapping portions of the recording heads that are adjacent to each other in the nozzle array direction are displaced from each other in the nozzle array direction. In practice, such a positional relationship between the overlapping portions illustrated FIG. 6 is realized by disposing recording heads for different colors having the same structure in the printer with a distance therebetween in the direction of arrow B. Alternatively, the positional relationship between overlapping portions illustrated FIG. 6 may be realized by using recording heads having different disposition of chips, instead of disposing the recording heads with a distance therebetween in the direction of arrow B in the printer.

In the present embodiment, the distances between the overlapping portions are different in accordance with the distance between the recording heads in the conveying direction (direction of arrow A). First, distances S1 and S2 between the overlapping portions will be described. The distance between two overlapping portions of the recording heads that are adjacent to each other in the conveying direction (direction of arrow A), the overlapping portions being adjacent to each other in the nozzle array direction (direction of arrow B), will be referred to as a distance S1. In FIG. 6, the distance between an overlapping portion 42K1 of the recording head 14K and an overlapping portion 42Lc1 of the recording head 14Lc corresponds to the distance S1. The distance between two overlapping portions of the recording heads that are separated from each other in the conveying direction (direction of arrow A), the overlapping portions being adjacent to each other in the nozzle array direction (direction of arrow B), will be referred to as a distance S2. In FIG. 6, the distance between an overlapping portion 42K2 of the recording head 14K and an overlapping portion 42C1 of the recording head 14Lc corresponds to the distance S2.

In the present embodiment, the distances S1 and S2 between the overlapping portions are set such that S2>S1. Thus, even when the sheet S continuously deviates one-way in the nozzle array direction as illustrated in FIG. 5, occurrence of non-uniformity of density is suppressed.

When the sheet S continuously deviates one-way in the nozzle array direction, the larger the distance between the recording heads, the larger the deviation E of the sheet S. In FIG. 6, the distance between the overlapping portion 42K2 and the overlapping portion 42C1 in the conveying direction (direction of arrow A) is larger than the distances between other overlapping portions, for example, the distance between the overlapping portion 42K1 and the overlapping portion 42Lc1 in the conveying direction. Therefore, the deviation E that may occur between the recording head 14K and the recording head 14C is larger than the deviation E that may occur between other recording heads. In the present embodiment, the distances between the overlapping portions are set such that S2>S1, so that overlapping of a region of the sheet S on which recording is performed by the overlapping portions of any two recording heads is suppressed.

That is, the present embodiment includes a recording head for a first color (for example, the recording head 14K), a recording head for a second color (for example, the recording head 14C), and a recording head for a third color (for example, the recording head 14Lc); and the overlapping portions of the recording heads for the second and third colors are adjacent to the overlapping portion of the recording head for the first color. The distance S2 between the overlapping portion of the recording head for the first color and the overlapping portion of the recording head for the second color is larger than the distance S1 between the overlapping portion recording head for the first color and the overlapping portion recording head for the third color.

The distances S1 and S2 may be set so that the regions recorded by the overlapping portions do not overlap even when the sheet S deviates to the maximum degree, which is estimated from the conveyance precision of the recording apparatus.

Modification of First Embodiment

Figure 7:
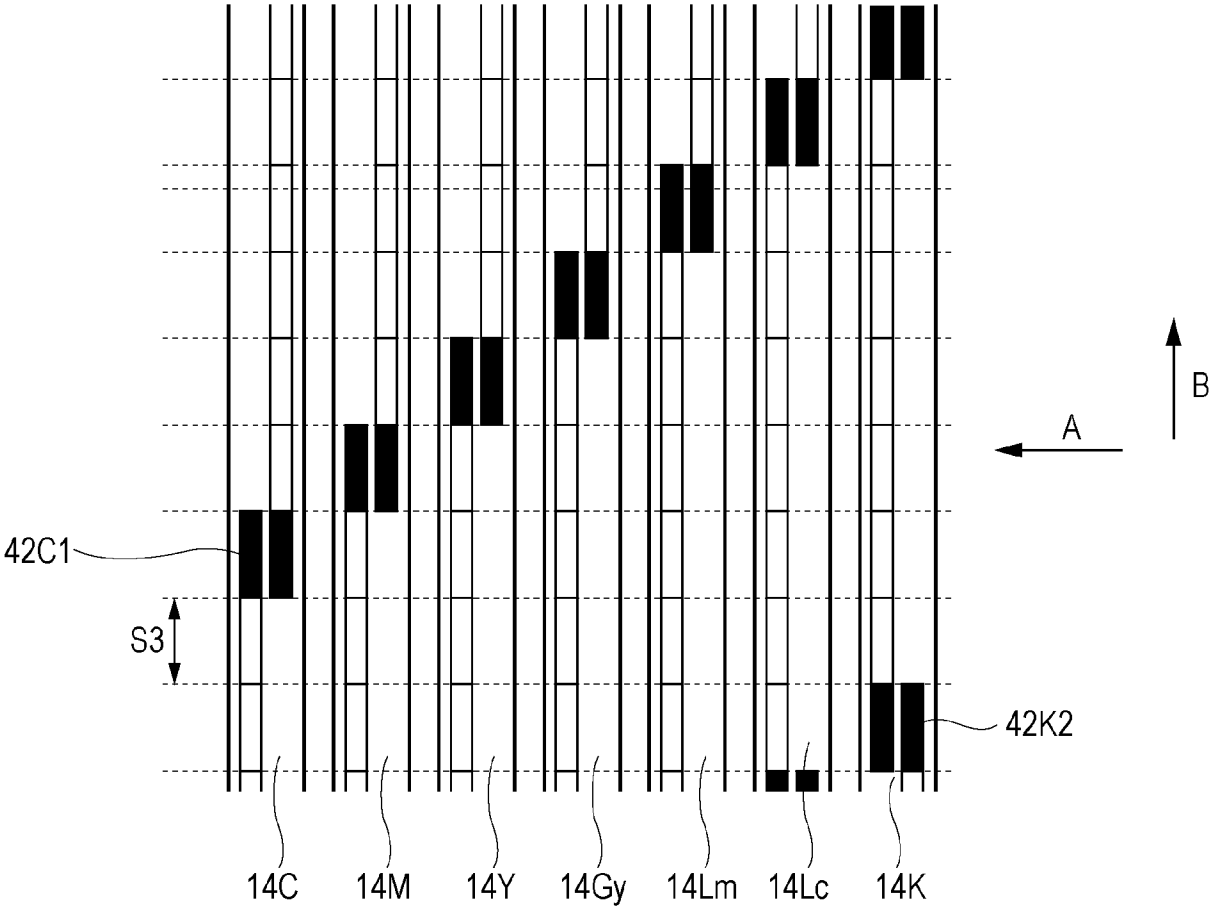
FIG. 7 illustrates the positional relationship between overlapping portions of the recording heads according to a modification of the first embodiment.

A modification of the first embodiment will be described. In the first embodiment, the overlapping portions are separated from each other in the nozzle array direction for all combinations of the recording heads whose overlapping portions are adjacent to each other in the nozzle array direction. However, the overlapping portions need not be displaced from each other for all combinations of the recording heads whose overlapping portions are adjacent to each other in the nozzle array direction. That is, if the overlapping portions are separated from each other with a distance therebetween in the nozzle array direction for the recording heads for two colors whose overlapping portions are adjacent to each other in the nozzle array direction, occurrence of non-uniform density in a region that is recorded by the overlapping portions for the two colors is suppressed. That is, the recording heads for the two colors are the recording head for a first color (for example, the recording head 14K) and the recording head for a second color (for example, the recording head 14C), the overlapping portion of the recording head for the first color and the overlapping portion of the recording head for the second color are separated from each other in the nozzle array direction. FIG. 7 illustrates the positional relationship between overlapping portions for different colors according to the modification. As illustrated in FIG. 7, also in the modification, recording heads 14K, 14Lc, 14Lm, 14Gy, 14Y, 14M, and 14C for seven colors are arranged in the conveying direction. In FIG. 7, overlapping portions of the recording heads are represented by black rectangles.

Next, characteristics of the present modification will be described. In the present modification, the distance between the overlapping portions that are adjacent to each other in the nozzle array direction (direction of arrow B) and that are included in the recording head that are adjacent to each other in the conveying direction (direction of arrow A) is zero. The distance between the overlapping portions that are adjacent to each other in the nozzle array direction (direction of arrow B) and that are included in the recording head that are separated from each other in the conveying direction (direction of arrow A) is S3 (>0).

As described above, when the sheet S continuously deviates one way in the nozzle array direction, the larger the distance between the recording heads, the larger the deviation E of the sheet S. By providing the distance S3 (>0) between the overlapping portion 42K2 and the overlapping portion 42C1 in the nozzle array direction, overlapping of regions recorded by the overlapping portions of the recording head 14K and the recording head 14C is suppressed. In contrast, the deviation of the sheet E is comparatively small for the combination of the recording heads that are adjacent to each other in the conveying direction. Therefore, the distance between the overlapping portions in the nozzle array direction is zero.

Thus, in the present modification, among the recording heads for a plurality of colors, the overlapping portions of the recording heads for two colors, the overlapping portions being adjacent to each other in the nozzle array direction, are displaced from each other in the nozzle array direction. Thus, for the overlapping portions for the two colors, occurrence of non-uniform density in a region recorded by the overlapping portions may be suppressed. In the present modification, the recording heads for the two colors are the recording head 14K for black and the recording head 14C for cyan. Because these two recording heads are separated from each other in the conveying direction (direction of arrow A), the deviation E of the sheet S is comparatively large. Therefore, the overlapping portion of the recording head 14K for black and the overlapping portion of the recording head 14C for cyan are displaced from each other in the nozzle array direction, so that occurrence of non-uniform density due to the overlapping portions that are highly likely to print the same region is suppressed.

Second Embodiment

Next, a second embodiment of the present invention will be described. The elements already described in the first embodiment will be denoted with the same numerals and the description thereof will be omitted. In the first embodiment and the modification of the first embodiment, the overlapping portions of the recording heads, the overlapping portions being adjacent to each other in the nozzle array direction, are displaced from each other. In contrast, in the present embodiment, the positions of the overlapping portions for the recording heads for two colors are the same in the nozzle array direction, so that the overlapping portions overlap each other in the conveying direction. According to the present embodiment, the length of the recording head in the nozzle array direction is reduced.

First, referring to FIG. 8, the flowchart of image processing will be described. In the following description, it is assumed that all steps of the image processing are performed by the printer 100. However, a part or all of the steps may be performed by an external apparatus (host apparatus).

In step S1, multivalued image data is input to the printer. The multivalued image data is 8-bit RGB data. Next, in step S2, color processing A is performed. This is gamut mapping, which compresses and expands the multivalued image data to colors that are reproducible by the printer. In the color processing A, the input RGB data is converted to multivalued data for R'G'B' that has been mapped.

In step S3, color processing B is performed. This is color separation processing, in which the converted data for R'G'B' is converted to data for ink colors used by the printer. Because the present embodiment uses seven color inks, conversion from R'G'B' to C, M, Y, Bk, Lc, Lm, and Gy is performed. In step S4, gradation correction is performed to correct the gradation characteristics of ink colors C, M, Y, Bk, Lc, Lm, and Gy. In the steps S2, S3, and S4, the conversion described above is performed using a lookup table.

In step S5, quantization is performed on the data whose gradation has been corrected for each ink color. To be specific, a generally used quantization method, such as error diffusion or dithering, is used. In step S6, the data that has been processed in steps S1 to S5 is supplied to the recording heads as signal values, sorted for recording, and allocated to the overlapping portions. Then, ink is ejected and recording is performed on a recording sheet.

In the color processing B of step S3, a lookup table, which contains one-to-one correspondence between the signal value for R'G'B' and the signal value for the ink colors C, M, Y, Bk, Lc, Lm, and Gy, is used. An example of the correspondence between signal values for R'G'B' and signal values for the ink colors is as follows.

Input values: R'=10, G'=10, B'=10
Output values: C=5, M=5, Y=5, Bk=220, Lc=0, Lm=0, Gy=20

Figure 9:
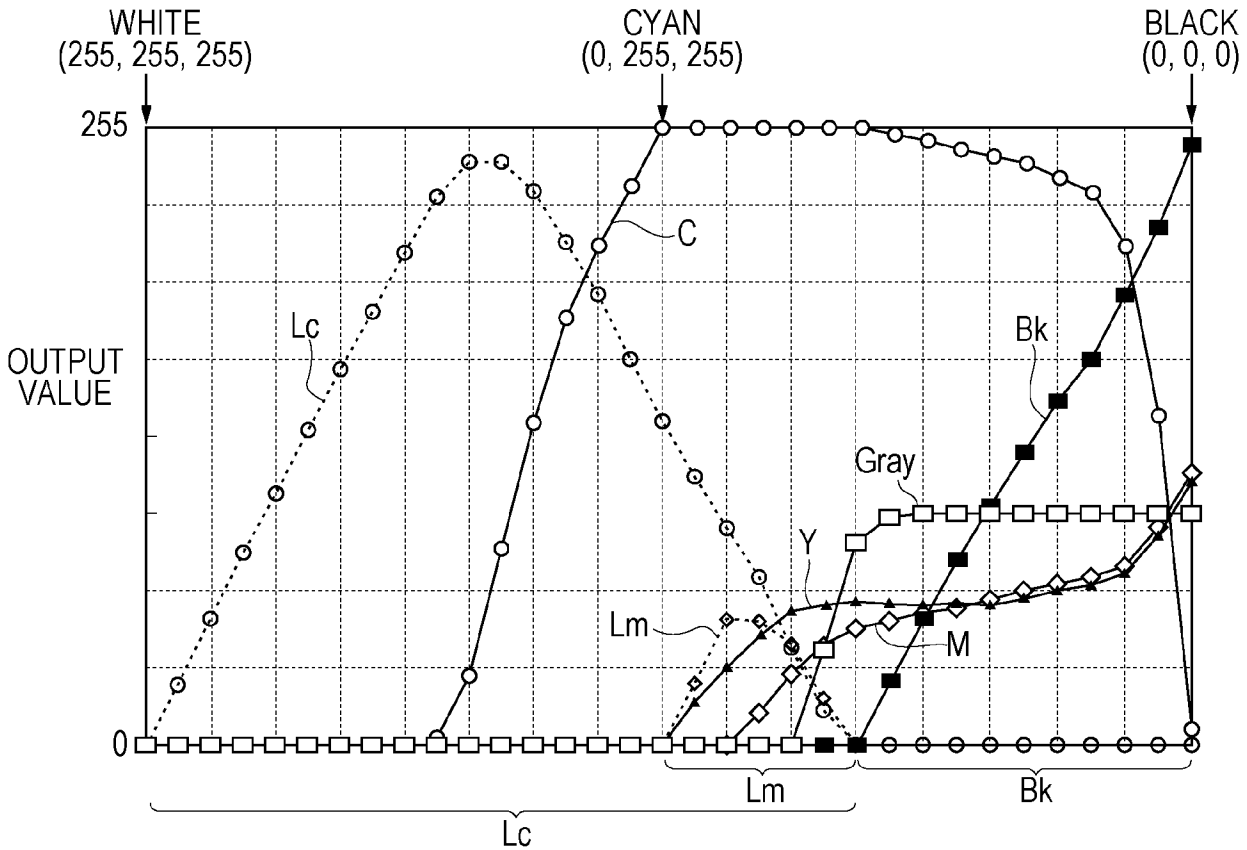
FIG. 9 is a graph illustrating a result of color conversion of RGB data in a cyan line.

FIG. 9 is a graph illustrating a result of ink color conversion in a white→cyan→black line in step S3. The horizontal axis represents the input signal value, and the vertical axis represents the output signal value (0 to 255). In the present embodiment, the recording heads for different colors eject the same amount of ink, and the larger the output value along the vertical axis, the larger the amount of ink ejected onto the recording sheets.

The R'G'B' signal values for white are converted to signal values for the ink colors M, Y, Bk, Lc, Lm, and Gy as follows.
Input values: R'=255, G'=255, B'=255
Output values: C=0, M=0, Y=0, Bk=0, Lc=0, Lm=0, Gy=0
When the color gradually changes from white to cyan, the output value first increases for the ink color Lc, and gradually shifts to the ink color C. For cyan, the R'G'B' signal values are converted to signal values for the ink colors C, M, Y, Bk, Lc, Lm, and Gy.
Input values: R'=0, G'=255, B'=255
Output values: C=255, M=0, Y=0, Bk=0, Lc=135, Lm=0, Gy=0 When the color changes form cyan to black, the complementary colors Lm and Y increase, and then Lm shifts to M. Meanwhile, Gray increases and finally reaches black.

In the present embodiment, light-colored inks (Lc, Lm) of relatively low density are used to improve graininess. These two inks are usually used for bright colors, and are rarely used simultaneously with Bk ink, which is used for reproducing dark colors. In FIG. 9, after the output values for Lc and Lm have become zero, the output value for Bk becomes larger than zero and then increases. That is, as illustrated in the lower part of FIG. 9, for the white→cyan→black sequence, the range in which Bk ink is used does not overlap the range in which Lc ink is used and the range in which Lm ink is used. Therefore, the combination of Bk ink and Lc ink, and the combination of Bk ink and Lm ink do not exist for any input signal values.

Recording heads for such inks that are simultaneously used with a low frequency may have the overlapping portions that are disposed at the same position in the nozzle array direction. Thus, the length of the recording heads in the nozzle array direction may be reduced. That is, even if the position of the overlapping portions are the same in the nozzle array direction, such inks, whose combination is used with a low frequency, are rarely used for recording simultaneously. Therefore, the positions of the overlapping portions may be the same in the nozzle array direction. The specific structure of the recording head according to the present embodiment will be described below in detail.

Figure 10:
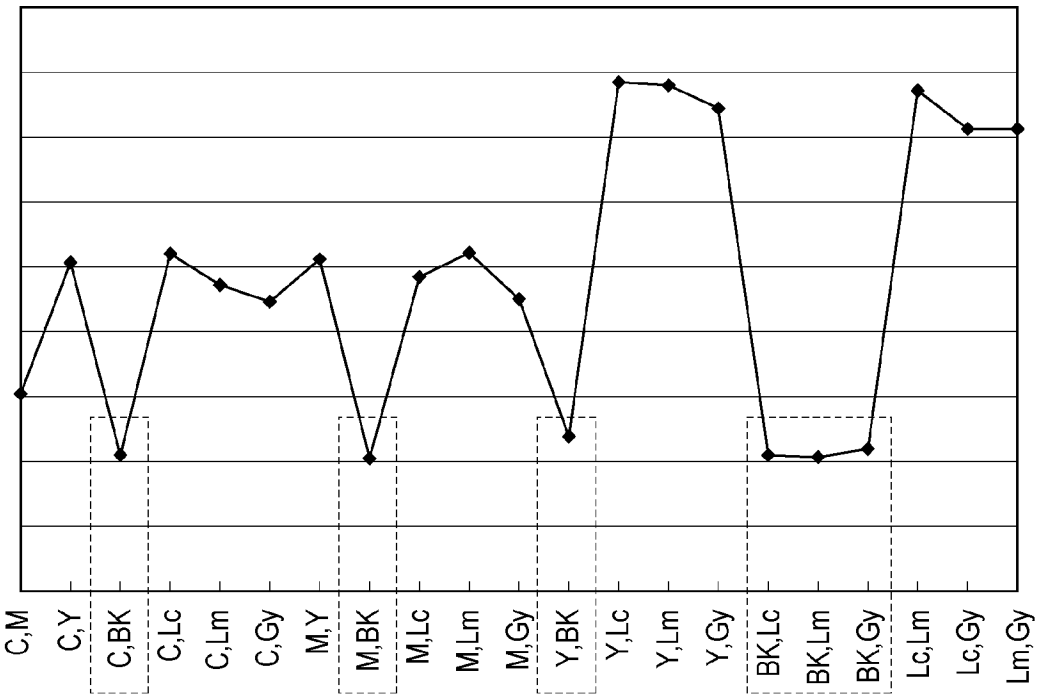
FIG. 10 is a graph illustrating the relationship between combinations of different inks and the frequency with which the inks are simultaneously used.

For lines other than the white→cyan→black line, the frequency with which combinations of different color inks that are simultaneously used are examined as follows. The printer according to the present embodiment includes the recording heads for seven colors. Thus, the number of combinations of two different colors is twenty-one. FIG. 10 is a graph illustrating the relationship between the twenty-one combinations of different inks that are simultaneously used and the frequency with which the combinations are used.

The frequency corresponds to the proportion of the number of colors for which two color inks are used to the number colors recordable by the printer (256×256×256). The proportion is obtained by counting, for all input signal values (RGB data) in step S1, the number of the input signal values for which the product of output signal values in step S5 are not zero. Because the output signal values in step S5 have been quantized, the product is not zero if and only if the signal values for the two colors are present, i.e., if the two colors are simultaneously used. Thus, by counting the number of the input signal values (RGB data) for which the above product is not zero, the frequency with which two different color inks are simultaneously used is obtained.

Referring back to FIG. 10, the horizontal axis represents twenty-one combinations of two different colors. The vertical axis represents the number of input signal values counted as described above. Therefore, the larger the number along the vertical axis, the combination of the inks are more frequently used.

As can be seen from FIG. 10, the following combinations of inks are used with low frequencies.

(1) Bk ink and M ink
(2) Bk ink and Lm ink
(3) Bk ink and C ink
(4) Bk ink and Lc ink
(5) Bk ink and Gy ink
(6) Bk ink and Y ink As described above, for the recording heads for ink colors that are simultaneously used with a low frequency, the positions of the overlapping portions may be the same in the nozzle array direction. In the present embodiment, the positions of the overlapping portions of the recording head for Bk and the recording head for Lc are the same in the nozzle array direction.

Figure 11:
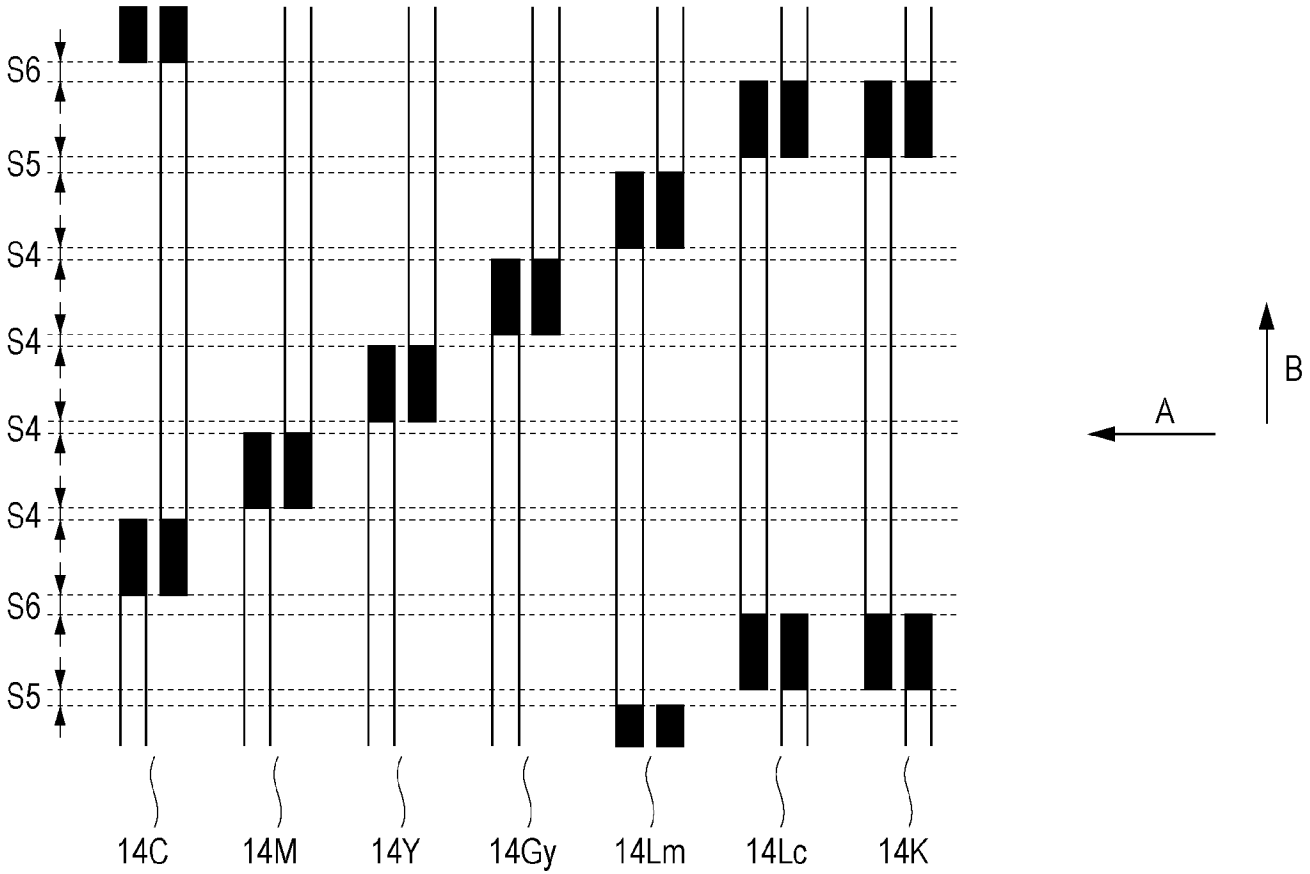
FIG. 11 illustrates the positional relationship between overlapping portions of recording heads according to a second embodiment.

FIG. 11 illustrates the positional relationship between the overlapping portions of the recording heads according to the present embodiment. As illustrated in FIG. 11, the recording heads 14K, 14Lc, 14Lm, 14Gy, 14Y, 14M, and 14C are arranged in the conveying direction. Solid black portions in FIG. 11 are the overlapping portions of the recording heads.

As illustrated in FIG. 11, for the recording head for Bk and the recording head for Lc, the positions of the overlapping portions are the same in the nozzle array direction, and the all areas of the overlapping portions for Bk and the overlapping portions for Lc overlap in the conveying direction. Therefore, the length of the recording head in the nozzle array direction is reduced. Moreover, because the Bk ink and the Lc ink are simultaneously used with a low frequency, the probability of the Bk ink and Lc ink being simultaneously used for recording and generates non-uniform density is low. Thus, according to the present embodiment, overlapping of regions that are recorded by the overlapping portions is suppressed, occurrence of non-uniform density is suppressed, and the length of the recording head in the nozzle array direction is reduced.

In the present embodiment, the overlapping portions of the recording heads, the overlapping portions being adjacent to each other in the nozzle array direction, are disposed with a distance therebetween in the nozzle array direction. In the present embodiment, distances S4, S5, and S6 are provided between the overlapping portions. The distance S6 between the overlapping portions of the recording heads for Bk (black) and C (cyan), which are separated from each other in the conveying direction, needs to be the largest, because the deviation E of the sheet S is large for the combination of Bk and C. The distance S5 between the overlapping portions of the recording heads for Bk (black) and Lm (light magenta), which are separated by a distance smaller than that for Bk and C, needs to be comparatively large, because the deviation E of the sheet S may become large. The distance S4 between the overlapping portions of the recording heads for other colors may be comparatively small, because the recording heads are adjacent to each other in the conveying direction. Therefore, in the present embodiment, the distances are set such that S6>S5>S4. Thus, overlapping of regions that are recorded by the overlapping portions is suppressed, and a high-quality image without non-uniform density is recorded. The distances S5 and S4 may be the same, because the difference in the effect of the deviation in conveyance is small.

In the present embodiment, the overlapping portions need not be displaced from each other in the nozzle array direction for all combinations of recording heads whose overlapping portions are adjacent to each other in the nozzle array direction. As long as the overlapping portions of two recording heads, the overlapping portions being adjacent to each other in the nozzle array direction, are separated from each other in nozzle array direction, non-uniform density that may occur in regions recorded by the overlapping portions of the two recording heads is reduced. In the present embodiment, the overlapping portions of two recording heads, the overlapping portions being adjacent to each other in the nozzle array direction, may be separated from each other in the nozzle array direction with the following two configurations.

In a first configuration, the overlapping portions of the recording heads for two colors, which are different from the two colors that are simultaneously used with a low frequency, are separated from each other in the nozzle array direction. In a second configuration, the overlapping portion of one of the recording heads for one of the two colors that are simultaneously used with a low frequency and the overlapping portion of the recording head, the overlapping portions being adjacent to each other in nozzle array direction, are separated from each other in the nozzle array direction.

Therefore, a more general expression of the present embodiment is as follows. First, the overlapping portion of the recording head for a first color and the overlapping portion of the recording head for the second color are separated from each other in the nozzle array direction. Second, if a fourth color and a different color are simultaneously used with a low frequency, the positions of the overlapping portion of the recording head for the fourth color and the overlapping portion of the recording head for the different color are the same in the nozzle array direction. The recording head for the different color may be different from the recording head for the first color and the recording head for the second color, or may be the same as one of the recording head for the first color and the recording head for the second color. In the description of the present embodiment using FIG. 9, Bk and Lc, and Bk and Lm are not simultaneously used. However, these colors may be used simultaneously. Even if these colors are simultaneously used, when the inks are used with a low duty cycle, non-uniform density does not become conspicuous. Therefore, the positions of the overlapping portions of the recording heads for colors that are used with a low duty cycle may be the same in the nozzle array direction or overlap each other in the conveying direction.

First Modification of Second Embodiment

Figure 12:
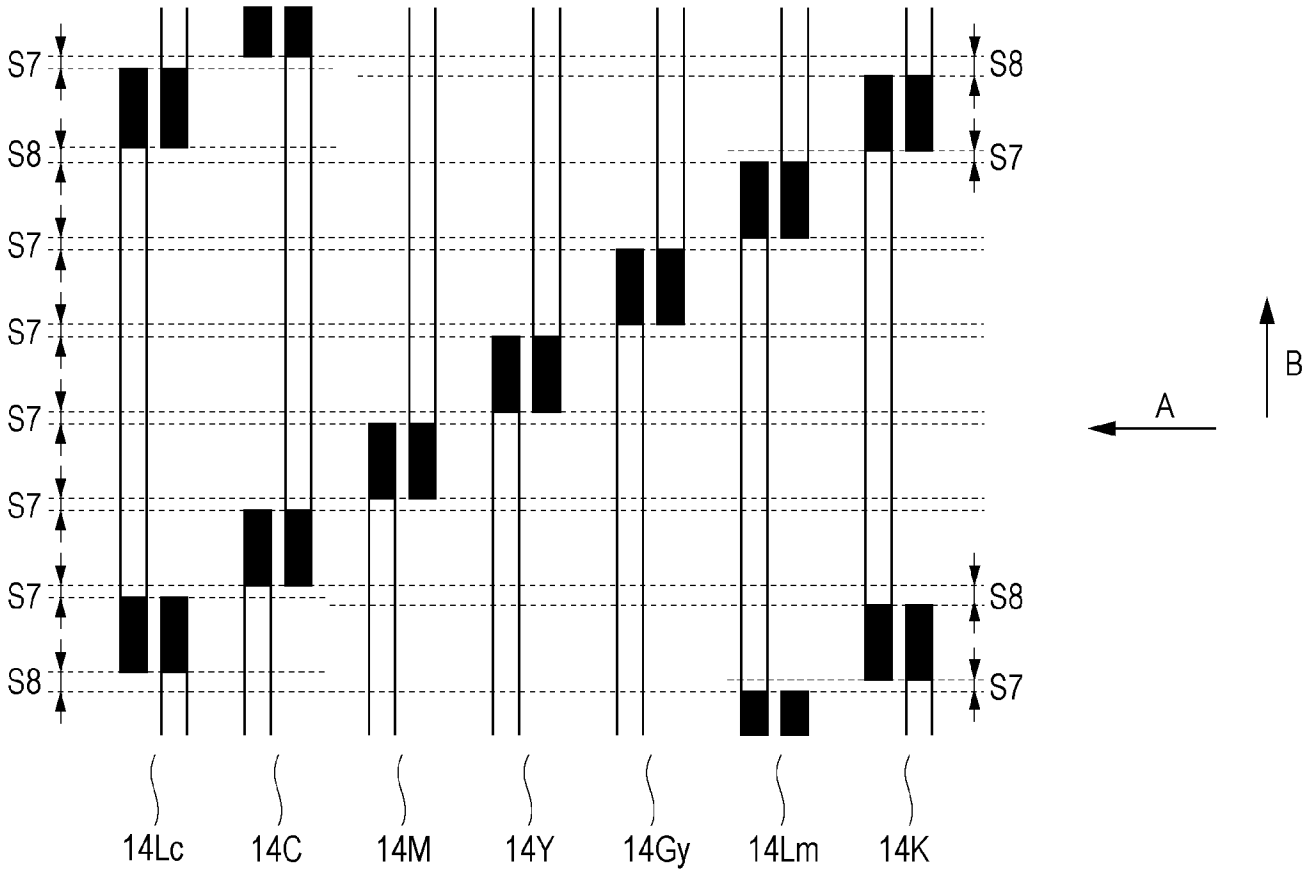
FIG. 12 illustrates the positional relationship between overlapping portions of recording heads according to a modification of the second embodiment.

Next, a first modification of the second embodiment will be described. FIG. 12 illustrates the positional relationship between overlapping portions for different colors according to the first modification. As illustrated in FIG. 12, the recording heads 14K, 14Lm, 14Gy, 14Y, 14M, 14C, and 14Lm are arranged in the conveying direction. Solid black portions in FIG. 12 are the overlapping portions of the recording heads.

In the present modification, the positions of the overlapping portion of a recording head 14Bk and the overlapping portion of the recording head for 14Lc are the same in the nozzle array direction. However, in the present modification, all areas of the overlapping portion of the recording head 14Bk and the overlapping portion of the recording head 14Lc do not overlap in the conveying direction. Instead, only parts of these overlapping portions overlap, and the overlapping portions for other colors are separated with a distance therebetween in the nozzle array direction. Also with the present modification, overlapping of regions that are recorded by the overlapping portions is suppressed, occurrence of non-uniform density is reduced, and the length of the recording head in the nozzle array direction is reduced.

In the present embodiment, distances S7 and S8 are provided. The distance S8, which is larger, is provided between the recording heads for black Bk and cyan C and between the recording heads for light magenta Lm and light cyan Lc, for which the recording heads are separated from each other in the conveying direction and the deviation amount E is large. In contrast, for other combination of colors, because the recording heads are adjacent to each other in the conveying direction, the distance S7 between the overlapping portions of such recording heads may be smaller than S8. Therefore, in the present embodiment, S8>S7. Thus, overlapping of the regions recorded by the overlapping portions is suppressed, and a high-quality image in which non-uniform density is reduced is recorded.

For the same reason as described using FIG. 7, in the second embodiment and the modification of the second embodiment, the overlapping portions need not be displaced from each other with a distance therebetween in the nozzle array direction for all combinations of the recording heads whose overlapping portions are adjacent to each other in the nozzle array direction.

Second Modification of Second Embodiment

Next, a second modification of the second embodiment will be described. In the second embodiment, the positions of the overlapping portions for the colors that are simultaneously used with a low frequency are the same in the nozzle array direction. In contrast, in the present modification, the overlapping portions for the colors that are simultaneously used with a small amount overlap each other in the nozzle array direction. This is because, even when the frequency of with which color inks are simultaneously used is low, if the amount of inks simultaneously used is large, non-uniform density becomes conspicuous.

The amount of ink simultaneously used corresponds to the total amount of ink for the number of colors (256×256×256) recordable by the printer. For all input signal values (RGB data) in step S1, the sum of the output signal values in step S5 is calculated. The output signal value in step S5 has been quantized. Therefore, by multiplying the sum by the input signal values (RGB data), the number of dots that are simultaneously recorded, i.e., the amount of ink used when two different color inks are simultaneously used is calculated.

Figure 13:
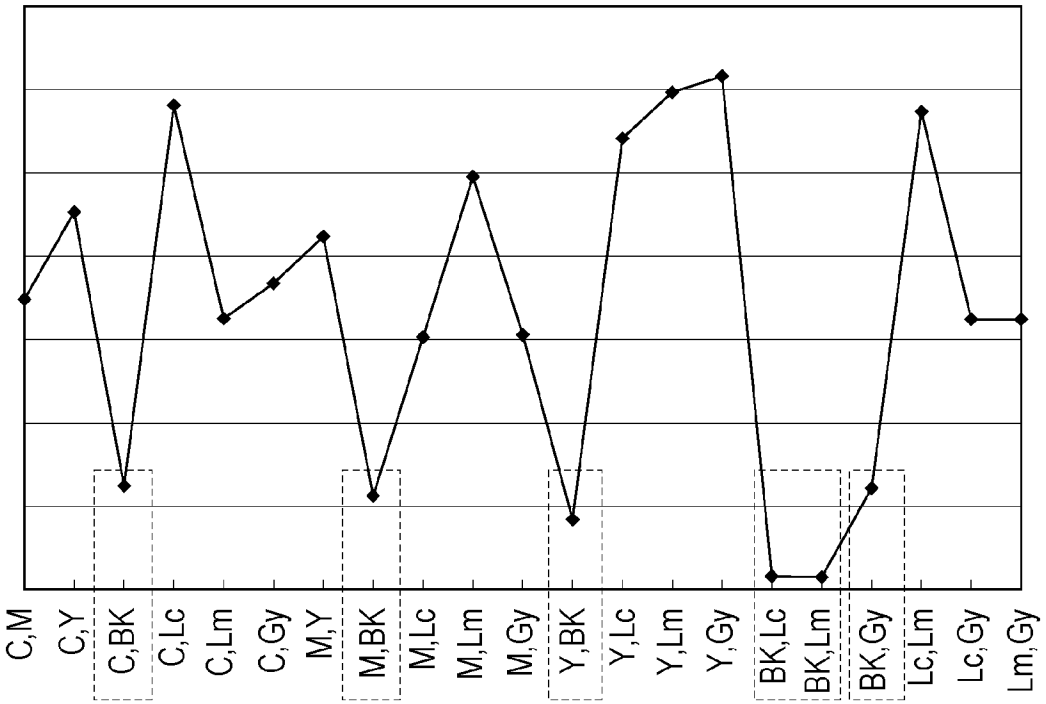
FIG. 13 is a graph illustrating the relationship between combinations of different inks and the amount of the inks simultaneously used.

FIG. 13 is a graph illustrating the relationship between (twenty-one) combinations of different inks and the amount of the inks simultaneously used. As can be seen from FIG. 13, combinations of inks that are simultaneously used with a small amount are as follows.

(1) Bk ink and Lc ink (2) Bk ink and Lm ink

Combinations of inks that are simultaneously used with a comparatively small amount are as follows.

(3) Bk ink and C ink (4) Bk ink and M ink (5) Bk ink and Y ink (6) Bk ink and Gy ink When the amount of ink simultaneously used is taken into consideration, disposing the overlapping portion for the Bk ink and the overlapping portions for the light-colored inks (Lc, Lm) at the same position in the nozzle array direction or disposing the overlapping portions so as to partially overlap in the nozzle array direction is effective. Therefore, as illustrated in FIG. 13, when the position of the overlapping portion of the recording head for Bk and the position of the overlapping portion of the recording head for Lc are the same in the nozzle array direction, even if the Bk ink and the Lc ink are simultaneously used, the inks are used with a small amount, so that non-uniform density is inconspicuous. As illustrated in FIG. 12, at least a part of the overlapping portions the recording head for Bk and the recording head for Lc may overlap in the conveying direction. In any case, with the present modification, occurrence of non-uniform density is suppressed, and the length of the recording head in the nozzle array direction is reduced.

Other

Some inkjet recording apparatuses use a high chroma ink having a so-called spot color or a special color, which is different from the process colors. Examples of such inks include an orange (Or) ink, a green (G) ink, and a blue (B) ink. These inks are used in a part of the color reproduction range, and are not simultaneously used with other inks. For a printer that uses such special colors, by overlapping the overlapping portion of the recording head for at least one of the special colors with the overlapping portion for the recording head for a color other than the special colors, the size of the recording head in the nozzle array direction may be reduced.

Figure 8:
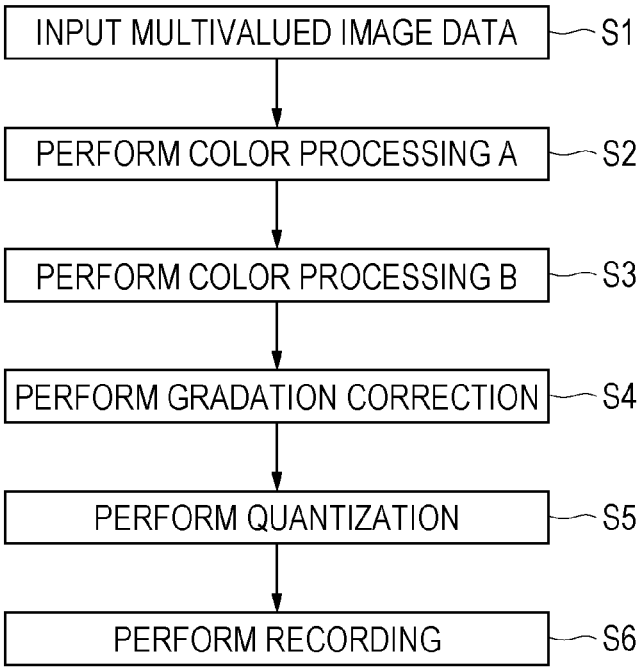
FIG. 8 is a flowchart of image processing performed by the inkjet recording apparatus of FIG. 1.

In FIGS. 10 and 13, the combinations of colors that are used with a low frequency or a small amount are based on the color processing illustrated in FIG. 8. For a different color processing, the combinations may be different from those in FIGS. 10 and 13. Also in such cases, the embodiments of the present invention are applicable.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-139954 filed Jun. 18, 2010, which is hereby incorporated by reference herein in its entirety.

What is claimed is:

1. An inkjet recording apparatus comprising:

recording heads for ejecting inks each corresponding to first, second and third colors respectively, and a recording control unit configured to control recording by ejecting the inks from the recording heads while moving a recording medium relative to the recording heads, wherein each of the recording heads includes a plurality of nozzle arrays that are arranged so as to be shifted from each other in an array direction of nozzles so that the nozzle arrays have an overlapping portion in which positions of the nozzles in the array direction correspond to each other, and the recording heads corresponding to the first color, the second color and the third color are arranged in an intersecting direction that intersects the array direction such that a position of at least a part of the plurality of nozzle arrays of the recording head corresponding to the first color, a position of at least a part of the plurality of nozzle arrays of the recording head corresponding to the second color, and a position of at least a part of the plurality of nozzle arrays of the recording head corresponding to the third color coincide with each other in the array direction, and wherein a distance between a position of the recording head for the first color and a position of the recording head for the second color in the intersecting direction is larger than a distance between the position of the recording head for the first color and a position of the recording head for the third color in the intersecting direction, and wherein a position of a first overlapping portion of the recording head for the first color is positioned, in the array direction, between a position of a second overlapping portion of the recording head for the second color, which is the closest to the first overlapping portion in the array direction among overlapping portions of the recording head for the second color, and a position of a third overlapping portion of the recording head for the third color, which is the closest to the first overlapping portion in the array direction among overlapping portions of the recording head for the third color, and wherein the position of the first overlapping portion in the array direction is separated from each of the positions of the second and third overlapping portions in the array direction, and wherein a distance between the positions of the first and second overlapping portions in the array direction is larger than a distance between the positions of the first and third overlapping portions in the array direction.

2. The inkjet recording apparatus according to claim 1, wherein among the recording heads for the plurality of colors, the recording head for the first color and the recording head for the second color are the most separated from each other in the intersecting direction.

3. The inkjet recording apparatus according to claim 1, wherein, among the recording heads for the plurality of colors, the recording head for the first color and the recording head for the third color are adjacent to each other in the intersecting direction.

4. The inkjet recording apparatus according to claim 1, further comprising the recording head for a fourth color, wherein a proportion of the number of colors that are recorded by using the fourth color ink and a different color ink that is different from the fourth color ink to the number of colors that are recordable by the inkjet recording apparatus is lower than a proportion of the number of colors that are recorded by using the first color ink and the second color ink to the number of colors that are recordable by the inkjet recording apparatus, and wherein at least a part of the overlapping portion of the recording head for the fourth color overlaps the overlapping portion of the recording head for the different color in the intersecting direction.

5. The inkjet recording apparatus according to claim 1, further comprising the recording head for a fourth color, wherein, a sum of the amount of the fourth color ink and the amount of a different color ink that is different from the fourth color ink used for colors that are recordable by the inkjet recording apparatus is smaller than a sum of the amount of the first color ink and the amount the second color ink used for colors that are recordable by the inkjet recording apparatus, and wherein at least a part of the overlapping portion of the recording head for the fourth color and the overlapping portion of the recording head for the different color overlap in the intersecting direction.

6. The inkjet recording apparatus according to claim 5, wherein the different color ink is the first color ink.

7. The inkjet recording apparatus according to claim 6, wherein a combination of the fourth color ink and the different color ink is a combination of a black ink and a light-colored ink.

8. The inkjet recording apparatus according to claim 1, wherein, for any one of orange, green, and blue ink, at least positions of parts of the overlapping portions of the recording heads overlap in the array direction.

9. The inkjet recording apparatus according to claim 1, wherein, for all combinations of two recording heads having overlapping portions that are adjacent to each other in the array direction, the overlapping portions are separated from each other in the array direction.

10. The inkjet recording apparatus according to claim 1, wherein the recording unit performs recording using the recording heads each corresponding to plurality of colors including the first and second colors and wherein the overlapping portions of the recording heads for the plurality of colors each include nozzles that are used for image recording and nozzles that are not used for image recording.

11. An inkjet recording method comprising:

performing recording by moving a recording medium relative to recording heads each corresponding to first, second and third colors respectively and by ejecting inks of the first, second and third colors from the recording heads, wherein each of the recording heads includes a plurality of nozzle arrays that are arranged so as to be shifted from each other in an array direction of nozzles so that the nozzle arrays have an overlapping portion in which positions of the nozzles in the array direction correspond to each other, and the recording heads corresponding to the first color, the second color and the third color are arranged in an intersecting direction that intersects the array direction such that a position of at least a part of the plurality of nozzle arrays of the recording head corresponding to the first color, a position of at least a part of the plurality of nozzle arrays of the recording head corresponding to the second color, and a position of at least a part of the plurality of nozzle arrays of the recording head corresponding to the third color coincide with each other in the array direction, and wherein a distance between a position of the recording head for the first color and a position of the recording head for the second color in the intersecting direction is larger than a distance between the position of the recording head for the first color and a position of the recording head for the third color in the intersecting direction, and wherein a position of a first overlapping portion of the recording head for the first color is positioned between a position of a second overlapping portion of the recording head for the second color in the array direction, which is the closest to the first overlapping portion in the array direction among overlapping portions of the recording head for the second color, and a position of a third overlapping portion of the recording head for the third color in the array direction, which is the closest to the first overlapping portion in the array direction among overlapping portions of the recording head for the third color, and wherein the position of the first overlapping portion in the array direction is separated from each of the positions of the second and third overlapping portions in the array direction, and wherein a distance between the positions of the first and second overlapping portions in the array direction is larger than a distance between the positions of the first and third overlapping portions in the array direction.

12. The inkjet recording method according to claim 11, wherein, recording is performed using the recording heads each corresponding to plurality of colors including the first, second and third colors and among the recording heads for the plurality of colors, the recording head for the first color and the recording head for the second color are the most separated from each other in the intersecting direction.

13. The inkjet recording method according to claim 11, wherein, for all combinations of two recording heads having overlapping portions that are adjacent to each other in the array direction, the overlapping portions are separated from each other in the array direction.

* * * * *